United States Patent [19]

Takahashi et al.

[11] Patent Number: 4,663,016

[45] Date of Patent: May 5, 1987

[54] APPARATUS FOR ELECTRODEPOSITION COATING

[75] Inventors: Yoshinobu Takahashi; Masayuki Kojima, both of Toyota, Japan

[73] Assignee: Toyota Jidosha Kabushiki Kaisha, Toyota, Japan

[21] Appl. No.: 771,184

[22] Filed: Sep. 3, 1985

Related U.S. Application Data

[63] Continuation of Ser. No. 604,422, Apr. 30, 1984, abandoned, which is a continuation of Ser. No. 454,076, Dec. 28, 1982, abandoned.

[51] Int. Cl.[4] ..... C25D 13/00; C25D 13/22

[52] U.S. Cl. ..... 204/299 EC; 204/300 EC

[58] Field of Search ..... 204/299 EC, 300 EC, 204/180.,2, 181.7, 180.7

[56] References Cited

U.S. PATENT DOCUMENTS

| | | | |
|---|---|---|---|
| 3,399,126 | 8/1968 | Turner | 204/300 EC |
| 3,399,128 | 8/1968 | Brewer et al. | 204/181 R |
| 3,496,082 | 10/1964 | Orem et al. | 204/300 EC |
| 3,592,755 | 9/1968 | Thornton | 204/299 EC |
| 3,951,775 | 4/1971 | Horton et al. | 204/299 EC |
| 4,210,505 | 7/1980 | Todoroki et al. | 204/300 EC |

FOREIGN PATENT DOCUMENTS

| | | | |
|---|---|---|---|
| 2147253 | 3/1973 | Fed. Rep. of Germany . | |
| 16756 | 9/1967 | Japan | 204/299 EC |
| 1338 | 1/1979 | Japan | 204/299 EC |

*Primary Examiner*—Howard S. Williams

*Attorney, Agent, or Firm*—Oblon, Fisher, Spivak, McClelland & Maier

[57] ABSTRACT

An apparatus for coating by electrodeposition a workpiece immersed in a reservoir containing coating material to be electro-deposited wherein the workpiece is set for a first electrode, and a second electrode is disposed along side wall and the bottom of the reservoir for effecting electrodeposition coating on the workpiece by applying DC voltage across the first and second electrodes. The second electrode is consisted of a plurality of conductive rods supported by supporting members at a predetermined height from the bottom of the reservoir. The conductive rods are disposed at a predetermined interval.

5 Claims, 3 Drawing Figures

APPARATUS FOR ELECTRODEPOSITION COATING

This application is a continuation of application Ser. No. 604,422, filed Apr. 30, 1984, now abandoned, which is a continuation of application Ser. No. 454,076, filed Dec. 28, 1982, now abandoned.

BACKGROUND OF THE INVENTION

The present invention relates to an apparatus for coating by electrodeposition a workpiece which is immersed in a reservoir containing coating material to be electrodeposited in which the workpiece is set for an electrode and the other electrode is disposed at a predetermined position in the reservoir and a DC voltage is applied across the electrodes.

In a conventional apparatus for coating panels with complex contour such as car bodies and the like by electrodeposition coating, for example catonic electrodeposition coating, electrodes (anodes) are disposed respectively along both side walls and the bottom of a reservoir in order to achieve uniformity of coating. The electrode horizontally disposed along the bottom of the reservoir is usually composed of a conductive flat panel member. In this apparatus, coating material is discharged from nozzles of a circulating riser toward the upper surface of the horizontal flat panel electrode, but pigment in the coating material will be deposited over the upper surface of the electrode and its surrounding to cover the electrode with the disadvantageous result of hindrance of electrode function and in some cases clearance corrosion of the electrode at the pigment deposited portion.

SUMMARY OF THE INVENTION

It is an object of the present invention to provide an apparatus for electrodeposition coating which can improve the function and durability of the electrode disposed along the bottom of the reservoir so as to remedy the above shortcomings of the prior art.

In the apparatus according to this invention, the electrode disposed along the bottom of the reservoir consists of a plurality of conductive rods supported at a predetermined height from the bottom of the reservoir, so that coating material discharged from the risers toward the conductive rods in the reservoir can be smoothly circulated and agitated and consequently pigment in the coating material can be prevented from deposition on the bottom of the reservoir and the upper surface of the electrode. Furthermore, even if the pigment in the coating material is deposited on each upper surface of the rods forming the electrode, the portion covered with the pigment is small in relation to the whole surface of the rod, that is the effective surface as the electrode, and consequently loss of electrode function is minimized, permitting the satisfactory function to be maintained for a long time.

The invention will become more fully apparent from the claim and the description as it proceeds in connection with the drawings.

DETAILED DESCRIPTION OF THE PREFERRED EMBODIMENTS

Figure 1:
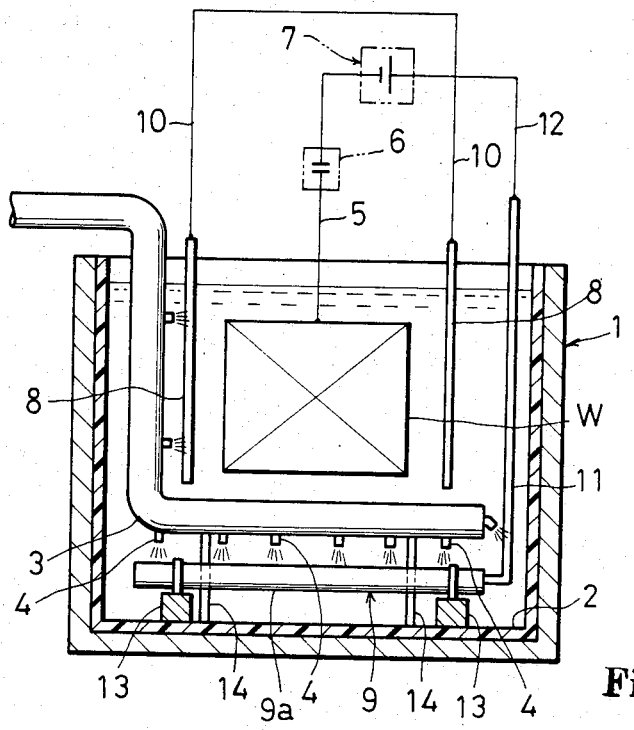
FIG. 1 is a vertical sectional view of an embodiment of the present invention.
Figure 2:
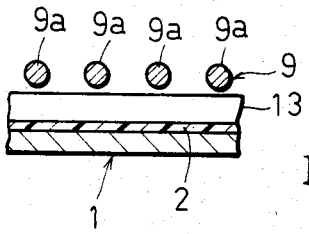
FIG. 2 is a fragmentary cross-sectional view illustrating the arrangement of the electrode (rods) disposed along the bottom of the reservoir of FIG. 1.

Referring now to FIGS. 1 and 2 of the drawings wherein a cationic electrodeposition coating apparatus is shown, a reservoir 1 contains coating material for cationic electrodeposition, and the side walls and the bottom of the reservoir 1 are completely covered with an insulating material 2 such as vinyl chloride resin and the like. There is provided in the reservoir 1 a predetermined number of circulating risers 3 supported by supporting members 14 fixed on the bottom of the reservoir 1, so at to circulate and agitate coating material. The circulating risers 3 are disposed in parallel relation with the bottom of the reservoir 1 and are arranged in parallel relation with each other. Each riser 3 has a plurality of nozzles 4 disposed at regular intervals for discharging the coating material.

A workpiece W to be immersed in the reservoir 1 is connected through a lead wire 5 and a connection 6 to the negative terminal of a DC generator 7 installed at a predetermined position outside of the reservoir 1 so that the workpiece W is set for the cathode.

Anodes 8 and 9 are disposed along each side wall and the bottom of the reservoir 1, respectively. The flat panel anode 8 suspended along each side wall of the reservoir 1 is connected through a lead wire 10 to the positive terminal of the DC generator 7 almost in the same way as usual. The anode 9 disposed along the bottom of the reservoir 1 consists of a plurality of conductive rods 9*a*. The rods 9*a* are connected to the positive terminal of the DC generator 7 through a lead rod 1 and a lead wire 12. Each of the rods 9*a* forming the anode 9 is a round bar or pipe and supported by supporting blocks 13 made of an insulating material such as vinyl chloride and the like at a predetermined height from the bottom of the reservoir 1. The rod 9*a* is made of a conductive material such as stainless steel, carbon, ferrite and the like under the necessity of rust resistance in an acid aquious solution (cationic electrodeposition coating material), poor solubility by electrolysis and no fear of undesirable influence of dissolved ions on finished coating and stability of coating material.

In operation, the workpiece W is coated by cationic electrodeposition, as is well known, when a DC voltage is applied across the workpiece W as a cathode and the anodes 8 and 9.

The anode 9 disposed between the circulating risers 3 and the bottom of the reservoir 1 consists of a plurality of round bars 9*a* which are supported at a predetermined height from the bottom of the reservoir 1. The round bars 9*a* are disposed in parallel relation with the circulating risers 3. Each of the risers 3 is positioned above and intermediate each of the round bars 9*a*. As the coating material is discharged from the nozzles 4 of the circulating riser 3, passing through the rods 9*a* toward the bottom of the reservoir 1, the coating material in the reservoir 1 is smoothly circulated and agitated to positively prevent pigment in the coating material from being deposited. Furthermore, even if a part of the pigment in the coating material is deposited on the upper surfaces of each rod 9*a*, the portion covered with the pigment is small in relation to the whole surface of the rod 9*a*, that is the effective surface as the electrode (anode), and consequently loss of electrode function is minimized, permitting the satisfactory function to be maintained for a long time.

Figure 3:
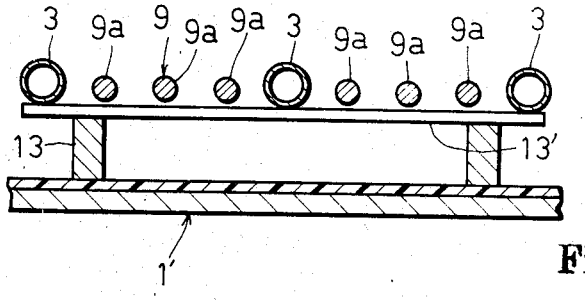
FIG. 3 is a fragmentary cross-sectional view illustrating the arrangement of the electrode and the circulating riser according to another embodiment.

In the above embodiment, the anode 9 consisting of a plurality of rods 9*a* is disposed below the circulating riser 3, but the riser 3 and the rods 9*a* forming the anode 9 may be disposed on the same plane through supporting members 13 and 13' as is shown in FIG. 3. The cross section of the rod 9*a* may be triangular, rectangular, polygonal or oval. The rods 9*a* are disposed in parallel to the riser 3, but they may be arranged at a desired angle with the same efficiency.

In the above embodiment, cationic electrodeposition coating is described, but of course the invention can be appied to anionic electrodeposition coating, power coating and the like.

While the invention has been described with reference to a few preferred embodiments thereof, it is to be understood that modification or variation may be made without departing from the scope of the invention which is defined by the appended claim.

What is claimed is:

1. An apparatus for coating, by cationic electrodeposition, a workpiece, comprising:

a reservoir having side walls and a bottom wall which are covered with an insulating material on their inside surfaces and containing a coating material to be electrodeposited, said workpiece acting as a first electrode;

a second electrode comprising vertical electrode members disposed along the side walls of said reservoir and a horizontal electrode member disposed along the bottom wall of said reservoir and under said workpiece;

a supporting member for supporting said horizontal electrode member, said supporting member being made of an insulating material;

said horizontal electrode member including a plurality of horizontal continuous conductive rods each length of said conductive rods being substantially equal to a length of the bottom of said reservoir said rods being substantially fully exposed to said reservoir and being located at a predetermined height from the bottom of said reservoir and arranged substantially equally spaced from each other said horizontal electrode member having a width dimension so as to extend substantially along the entire bottom surface of said reservoir; and a circulating riser independent of said second electrode provided in said reservoir for circulating and agitating said coating material, said circulating riser having a plurality of nozzles for discharging said coating material;

wherein said circulating riser comprises a horizontal portion disposed under said workpiece and between said workpiece and said horizontal electrode and a vertical portion disposed between said side wall of said reservoir and said vertical electrode member, wherein said nozzles are directed toward said vertical electrode member and downward toward the bottom of said reservoir.

2. The apparatus as defined in claim 1, wherein said conductive rods are round bars.

3. An apparatus according to claim 1, wherein the coating material discharged from said nozzles prevents the deposition of pigment material from said coating material on said rods.

4. An apparatus for coating, by cationic electrodeposition, a workpiece, comprising:

a reservoir having side walls and a bottom wall which are covered with an insulating material on their inside surfaces and containing a coating material to be electrodeposited, said workpiece acting as a first electrode, a second electrode comprising vertical electrode members disposed along the side walls of said reservoir and a horizontal electrode member disposed along the bottom wall of said reservoir and under said workpiece;

a supporting member for supporting said horizontal electrode member, said supporting member being made of an insulating material;

said horizontal electrode member including a plurality of horizontal continuous conductive rods each length of said conductive rods being substantially equal to a length of the bottom of said reservoir said rods being substantially fully exposed to said reservoir and being located at a predetermined height from the bottom of said reservoir and arranged substantially equally spaced from each other said horizontal electrode member having a width dimension so as to extend substantially along the entire bottom surface of said reservoir; and a circulating riser independent of said second electrode provided in said reservoir for circulating and agitating said coating material, said circulating riser having a plurality of nozzles for discharging said coating material;

wherein said circulating riser comprises a horizontal portion disposed under said workpiece and on the said level plane as that of said horizontal electrode member and a vertical portion disposed between said side wall of said reservoir and said vertical electrode member, wherein said nozzles are directed toward said vertical electrode member and downward toward the bottom of said reservoir.

5. The apparatus as defined in claim 4, wherein said conductive rods are round bars.

* * * * *